US006488467B2

(12) United States Patent
Czechowski et al.

(10) Patent No.: US 6,488,467 B2
(45) Date of Patent: Dec. 3, 2002

(54) INTEGRALLY CAST VOLUTE STYLE SCROLL AND GEARBOX

(75) Inventors: Edward S. Czechowski, Orchard Park, NY (US); Robert M. Kolodziej, Varysburg, NY (US); John Battershell, Hamburg, NY (US)

(73) Assignee: Cooper Cameron Corporation, Houston, TX (US)

( * ) Notice: Subject to any disclaimer, the term of this patent is extended or adjusted under 35 U.S.C. 154(b) by 0 days.

(21) Appl. No.: 09/818,405

(22) Filed: Mar. 27, 2001

(65) Prior Publication Data

US 2002/0141861 A1 Oct. 3, 2002

(51) Int. Cl.[7] ..... F04D 1/00
(52) U.S. Cl. ..... 415/122.1; 415/915
(58) Field of Search ..... 415/122.1, 124.1, 415/915, 66, 60, 179, 124

(56) References Cited

U.S. PATENT DOCUMENTS 4,047,848 A * 9/1977 Poole ..... 415/122.1
4,181,466 A 1/1980 Owen ..... 415/204
5,611,663 A * 3/1997 Kotzur ..... 415/122.1
6,050,780 A * 4/2000 Hasegawa et al. ..... 417/423.5
6,234,749 B1 * 5/2001 Hasegawa et al. ..... 415/122.1

* cited by examiner

*Primary Examiner*—Edward K. Look
*Assistant Examiner*—Kimya N McCoy
(74) *Attorney, Agent, or Firm*—Michael F. Hartmann; Peter A. Bielinski

(57) ABSTRACT

A casting technique is disclosed which improves efficiency and reduces fabrication and assembly cost for a centrifugal compressor. The volute is cast integrally with the impeller housing to allow closer radial tolerances to be used to improve efficiency. In the preferred embodiment, compressors for multi-stage compression are assembled with intercoolers and the integral volute is cast together with the impeller housing and the lower gearbox housing and the associated intercooler. Efficiency increases of 2% or more are achievable. In multistage applications, efficiency gains in the early stages are compounded in each subsequent stage.

21 Claims, 4 Drawing Sheets

INTEGRALLY CAST VOLUTE STYLE SCROLL AND GEARBOX

FIELD OF THE INVENTION

The field of this invention is centrifugal compressors featuring an integrally cast volute and more particularly to assemblies of compressors for multistage compression wherein the integral casting further includes a gearbox and intercooler housings.

BACKGROUND OF THE INVENTION

Centrifugal compressors supply oil free compressed gas in a variety of industrial applications. A common application is for plant air systems to supply a motive force for valve actuators and pneumatic cylinders for use in robotic applications, as one example. Centrifugal compressors feature an impeller mounted in a closely conforming impeller chamber. The chamber features an axial inlet port to allow fluid entry toward the center of the impeller. Fluid is drawn into the impeller due to its rotation at speeds which can exceed 75,000 revolutions per minute (RPM). The rotation of the impeller propels the fluid through an annular diffuser passageway and into a surrounding volute. The energy imparted into the fluid by the impeller rotation increases the fluid velocity and consequently it pressure as the fluid passes the diffuser passageway and into the scroll or volute. The diffuser pas sage way has inside and outside radial dimensions for each circumferential station of the impeller chamber and scroll. By definition, the inside radius of the diffuser section corresponds to the distance to the diffuser throat or the location at which the annular port or passageway has the smallest axial width for the given station, the diffuser section extending outwardly for the remainder of the annular passageway.

In the past, centrifugal compressors have featured a bolt on scroll/volute cover, which encompassed portions of the impeller chamber, and the diffuser passageway and the volute outlet passageway. U.S. Pat. No. 4,181,466 is illustrative of a bolt on component featuring the fluid entry 51 and the volute 50, which is also secured to the bearing housing 15 by a V-clamp 49. One main problem with the bolt on scroll/volute cover incorporating the volute was the effective control of tip clearance between the impeller and the inlet passageway and the clearance between the impeller and the volute outlet. Due to the bolt-on construction previously employed, machining costs and assembly costs affected the finished cost of the product. The assembly of a plurality of components required the use of greater clearances around the impeller, which sacrificed compressor efficiency. This, in turn, required larger drivers and higher operating costs for electric power. Since each assembled component had a manufacturing tolerance, the final clearance near the impeller had to be sufficiently large to accommodate a situation where all the tolerances in the individual components of the assembly turned out within specification but all dimensions on the individual components were off from the ideal dimension and on the same side of the tolerance allowed.

Another problem with bolt on volutes, ie. 24 and 26, is the extra space and mass taken up by that type of assembly which could become important in situations where ease of installation and maintenance is important to serviceability. For example, as will be explained below when the preferred embodiment is described, use of bolt-on volutes (such as 24 and 26) precludes access to the driver shaft for an oil pump to be directly driven. The extra housing thickness for each stage in a multi stage skid could preclude a direct drive on the oil pump and may necessitate a separate electrical drive for the oil pump. This would be undesirable in the event of an electrical failure. In an electrical failure, the impeller bearings need lubrication as the impeller slows from its operating speed of 75,000 RPM or more. Bearing failure could result with an electrically driven oil pump because it would stop delivering oil too abruptly on power failure. A power takeoff from the main drive shaft, which could involve gears or belts adds to the complication of packaged systems and tends to complicate access when maintenance is required.

What is needed is a technique to obtain better efficiency from a centrifugal compressor, whether running alone or connected to others in a multi-stage compression application. One of the objects of the present invention is to realize efficiency and operating cost improvements by integrally casting the volute as a part of the gearbox. Another objective is the reduction of radial clearance on the impeller, which results in an improvement of its efficiency. Another objective is to reduce production and assembly costs. These and other advantages of the present invention will become more apparent to a person of skill in the art from a review of the description of the preferred embodiment described below.

SUMMARY OF THE INVENTION

A casting technique is disclosed which improves efficiency and reduces fabrication and assembly cost for a centrifugal compressor. The volute is cast integrally with the gearbox base to allow closer radial tolerances to be used to improve efficiency. In the preferred embodiment, compressors for multi-stage compression are assembled with intercoolers and the integral volute is cast together with the impeller housing and the lower gearbox housing and the associated intercooler. Efficiency increases of 2% or more are achievable. In multistage applications, efficiency gains in the early stages are compounded in each subsequent stage.

DETAILED DESCRIPTION OF THE PREFERRED EMBODIMENT

Figure 1:
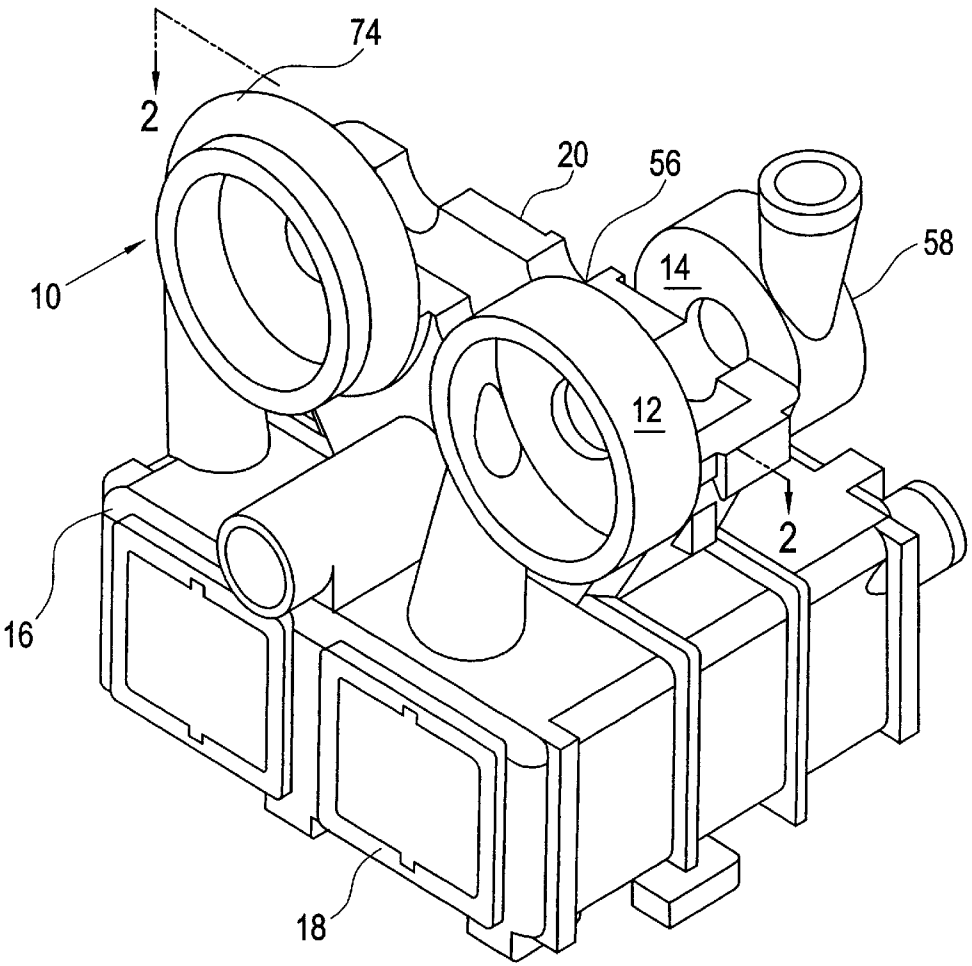
FIG. 1 is a perspective view of a three-stage centrifugal compressor skid showing the first stage compressor housing with volute cast integrally with the lower gearbox housing and the first stage intercooler housing.

Referring to FIG. 1, the preferred embodiment is illustrated in a perspective view, with portions removed for clarity. The motor driver for the package is omitted. The package comprises a first stage 10, a second stage 12, and a third stage 14. In essence, FIG. 1 is a drawing of a casting, which further comprises a first stage intercooler housing 16, a second stage intercooler housing 18 and the lower end of the gearbox 20. An after-cooler (not shown) can be used after the third stage 14. First stage 10 has an inlet 22 omitted from FIG. 1 but shown in section in FIG. 2. Second stage 12 has a differently configured inlet section 24 as compared to the first stage inlet 22. Third stage 14 has an inlet 26 similarly configured to inlet 24. The present invention relates to the configuration of volute scroll 74 and its complementary inlet 22. That configuration can also be used in second stage 12 and third stage 14 within the scope of the invention.

The first stage 10 has been configured differently than stages 12 and 14 to illustrate the difference between the prior known technique (illustrated in stages 12 and 14) from the technique of the present invention illustrated in the first stage 10. It is also different than another known technique as described in FIG. 4, item 90. It should be noted that the invention does not presuppose multiple stages and the details of the first stage 10 can be employed in a single stage installation or in a multi-stage installation, on one or more of the stages, all within the scope of the invention.

Referring again to FIG. 2, shaft 28 has a coupling 30 connected at its end. The motor driver (not shown) is coupled to coupling 30. Shaft 28 supports bullgear 32 in gear box 20. Pinion gear 34 meshes with gear 32 to drive impeller 36 in first stage 10. Shaft 38 supports the impeller 36 as well as pinion gear 34 and seals 40 along with bearings 42, disposed on either side of pinion gear 34. On the other side of the gear box 20, another pinion gear 44 is supported on a shaft 46 to operate impellers 48 and 50 on the second stage 12 and third stage 14 in tandem. Similar seal and bearing arrangements are used on shaft 46 as on shaft 38. Mounted to the end of shaft 28 is an oil pump 52, directly connected by a coupling 54.

Figure 2:
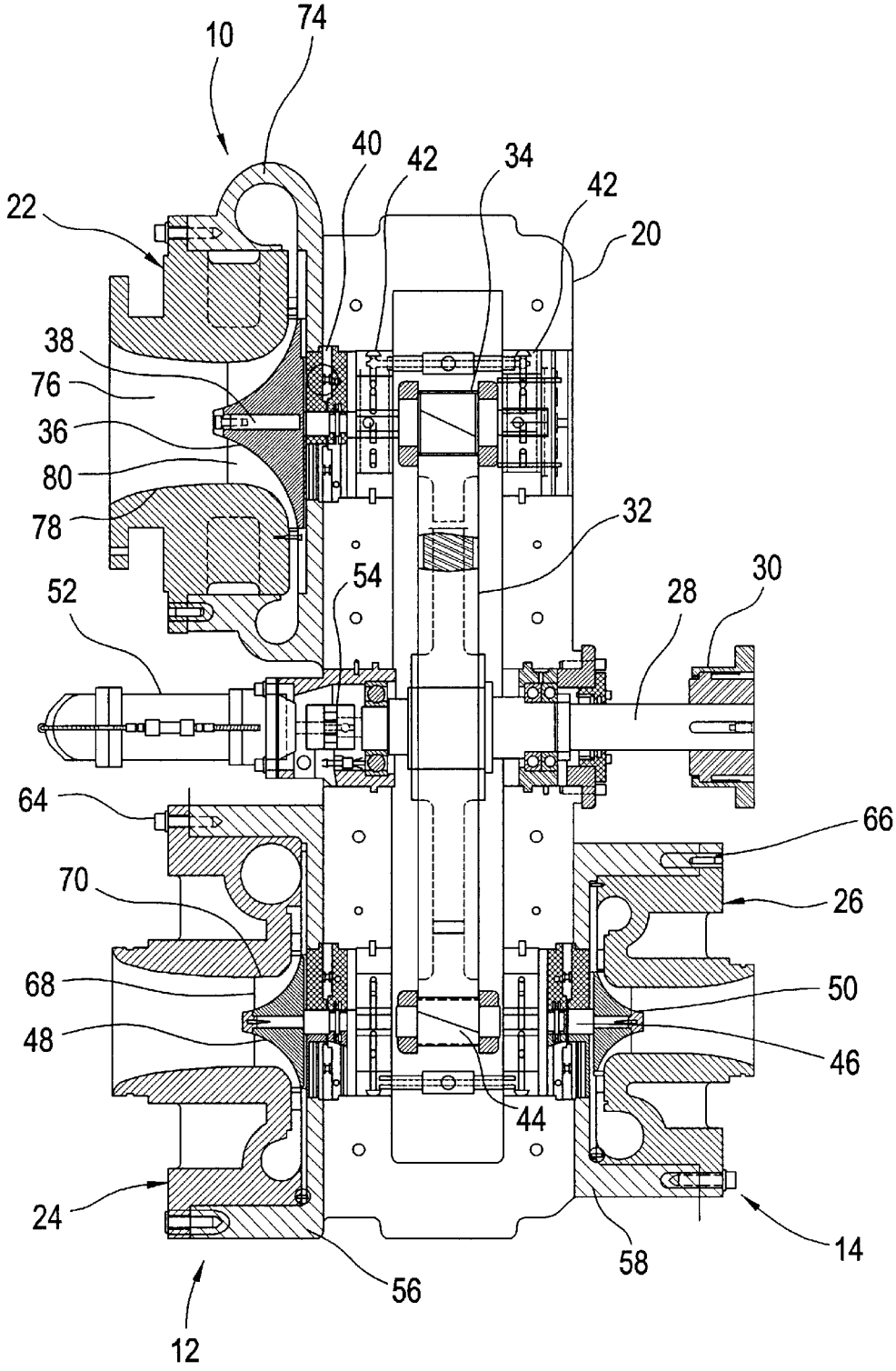
FIG. 2 is a section view along lines 2—2 of FIG. 1.
Figure 3:
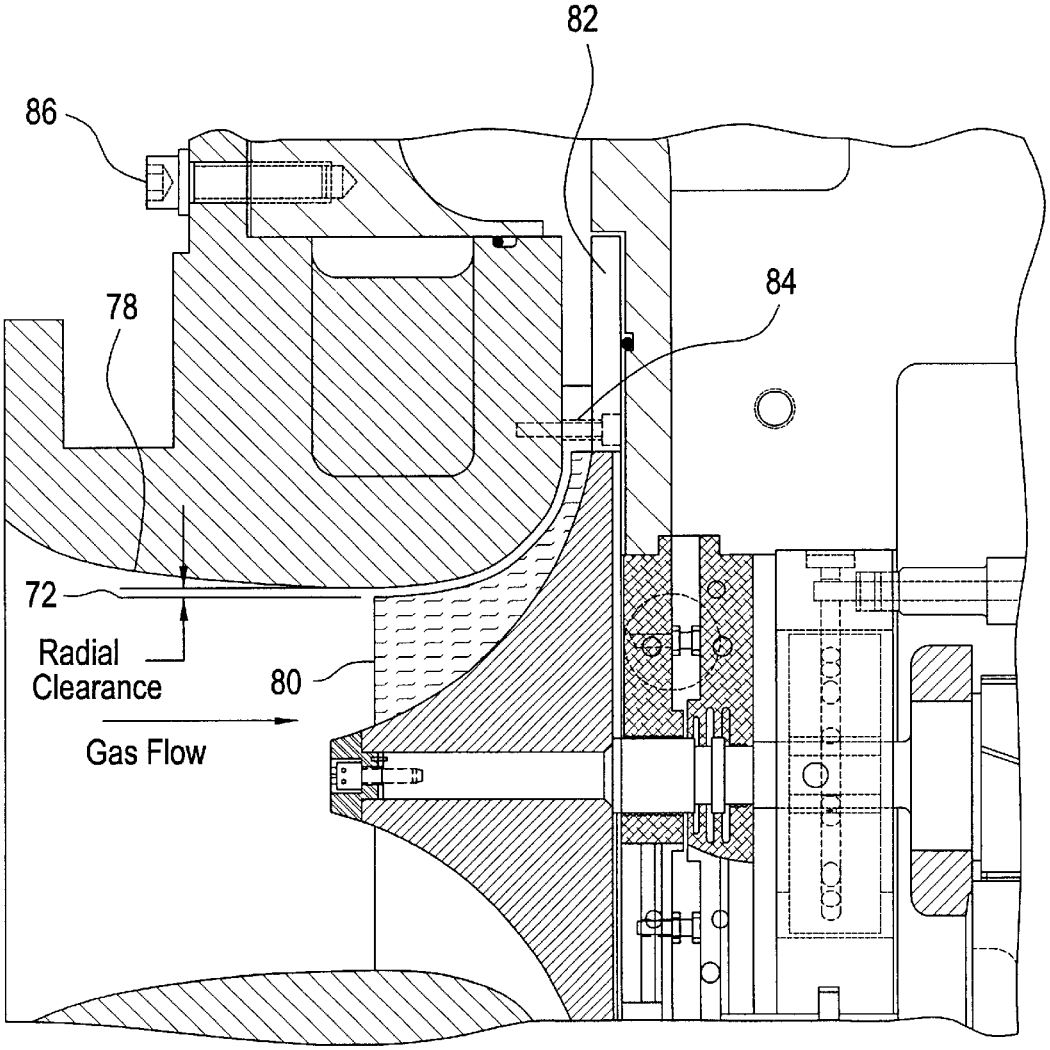
FIG. 3 is a close up view of the first stage volute-type scroll housing shown at the top of FIG. 2.
Figure 4:
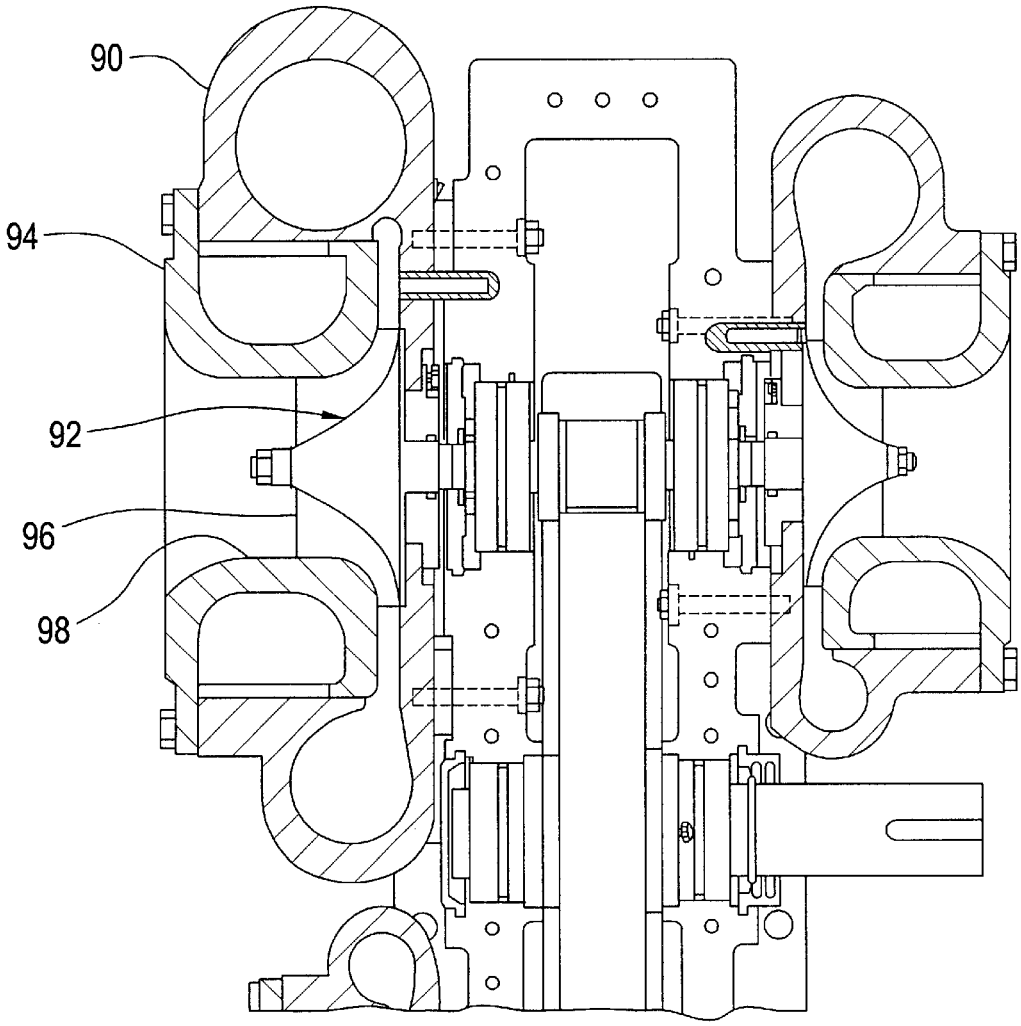
FIG. 4 PRIOR ART
FIG. 4 is a close up view of a prior art bolt on volute-type scroll housing typically used as an industry standard centrifugal compressor.

As seen in FIGS. 1 and 2, the second and third stages, 12 and 14 are different than the first stage 10. The housings 56 and 58 are cylindrically shaped and receive a combination inlet/volute 24 and 26 respectively. Bolts 64 and 66, respectively secure the combination inlet/volute respectively to housings 56 and 58. The housings 56 and 58 are cast integrally with the lower gear box 20 and the intercooler housings 16 and 18. Second and third stages 12 and 14 illustrate the prior known technique and are included in the illustrated three-stage system to provide contrast for a clearer understanding of the advantages of the present invention. FIG. 4 also illustrates a prior art technique, which provides further contrast and understanding of the advantages of the present invention. In the illustrative stage 90 of FIG. 4, the machined scroll/volute 90 is a complicated piece having numerous machined surfaces, each of which necessarily has a tolerance on one or both sides of the ideal dimension. Impeller 92 has a plurality of blades 96 extending radially from near its center. A clearance in the radial direction is required as between the blades 96 and surface 98 on inlet/volute 94. The location and orientation of this clearance is also seen in FIG. 3, which is a close-up of first stage 10, illustrating the clearance in the case of the present invention. The clearance 72 in the first stage 10 can be reduced to less than 0.020 inches as compared to the stage 90 where the counterpart clearance can run in the range of 0.024–0.035 inches or greater. The clearance 72 is obtained solely as a result of a casting followed by a machining process. To date, commercially available equipment of the type shown in FIG. 4 has not been built with smaller clearances. While, theoretically, a coating process can be employed to further reduce clearances in the prior FIG. 4 design below 0.024 inches, practically, these techniques have not been employed in centrifugal compressor applications for reasons of quality control problems and prohibitive cost.

The reason a smaller clearance is obtained in the first stage 10 is that it incorporates a volute type scroll as the housing 74. Inlet 22 has an opening 76 made of a surface 78, which conforms to the outer periphery of blades 80. The radial clearance 72 eventually becomes an axial clearance in conformity to the shape of blades 80. Since the volute is cast integrally to the housing 74 there are fewer surfaces to machine on the casting and on inlet 22 to fit them up. The ultimate blade clearance 72 can be smaller than in the stage 90 because there are fewer opportunities for the accumulated tolerances on the various machined surfaces to add up when the volute type scroll is cast integrally as housing 74. There are also reduced man-hours for assembly of the first stage 10 as well as labor savings in reduced machining. The disadvantage of the second stage 12 is that by combining the volute into the inlet 60 and then inserting the inlet 60 into the cylindrically shaped housing 56 the outer profile of housing 56 is increased due to a near doubling of the wall thickness at the periphery. To illustrate the concept, had the first stage 10 been built in the same manner as the second stage 12 using the same exterior dimensions for the casting shown in FIG. 1, there would have been no room to mount the oil pump 52 and coupling 54 to the shaft 28 between the first and second stages 10 and 12 respectively. As previously stated, being able to power the oil pump 52 off of shaft 28 becomes an issue if there is a power failure from the perspective of protecting the bearings such as 42. The other alternative of simply making the entire casting larger adds significant cost to the finished product.

It should be noted that with regard to the first stage 10, that the diffuser plate 82 is secured to inlet 22 with bolts 84 before fitting up inlet 22 to the volute type scroll housing 74 using bolts 86. The clearance 72 minimization allows the first stage to achieve an efficiency improvement of 1–2% and slightly more. This improvement is magnified in the subsequent stages of compression. Operating expenses can be reduced and a smaller driver utilized because of the reduction in internal leakage from use of smaller clearances. Of course, even greater efficiency can be obtained from using the volute type scroll cast integrally as the housing in all stages in a multi-stage assembly such as shown in FIG. 1. The oil pump 52, even if there is a power failure, continues to deliver enough oil to all the bearings as shaft 28 slows down but continues to drive the oil pump 52.

While the invention has been described and illustrated in detail in the drawings and foregoing description, the same is to be considered as illustrative and not restrictive in character, it being understood that only the preferred embodiment has been shown and described and that all changes and modifications that come within the scope of the claims below are the full scope of the invention being protected.

We claim:

1. A compression system comprising at least one centrifugal compressor, said centrifugal compressor further comprising:

an impeller further comprising a plurality of blades having an outer edge and extending from adjacent a center thereof, said impeller supported on an impeller shaft;

a compressor housing comprising an inlet in general axial alignment with said center, said inlet having an inside surface generally conforming to said outer edge of said blades to define a clearance there-between, said clearance, in the direction of fluid flow, extending originally axially in general alignment with said shaft and then curving for a substantially radial orientation with respect to said impeller shaft;

said axial portion of said clearance comprising a distance smaller than 0.024 inches, said clearance achieved solely by producing and machining said housing;

a gearbox housing component; and said compressor housing comprises a volute type scroll integrally cast with said gearbox housing component.

2. The compression system of claim 1, wherein:

said axial portion of said clearance is 0.020 inches and smaller.

3. The compression system of claim 2, wherein:

said integral volute type scroll having an inlet opening to accept said inlet which comprises a distinct component attachable to said housing to create said clearance with said blades, said compressor housing further comprises an outlet and a shaft opening through which said shaft is inserted.

4. The compression system of claim 3, further comprising:

a diffuser secured to said inlet and positioned around said impeller when said inlet is fitted to said compressor housing.

5. The compression system of claim 3, further comprising:

said gearbox having an input shaft and a plurality of gears to rotate said impeller shaft; and an oil pump directly driven from said gearbox input shaft.

6. The compression system of claim 3, wherein:

said at least one centrifugal compressor comprises a plurality of centrifugal compressors with at least two having compressor housings comprising integral volute type scrolls and an inlet which comprises a distinct component, said compressors connected in series for staged compression.

7. The compression system of claim 6, further comprising:

at least one intercooler housing, said compressor housings cast as one piece with said intercooler housing.

8. The compression system of claim 7, further comprising:

said gearbox housing component integrally cast with said intercooler housing and said compressor housings.

9. The compression system of claim 8, further comprising:

an input shaft extending through said gear box housing component and operably connected by gears to compressor shafts extending from said compressors, said compressor shafts disposed on opposite sides of said input shaft; and an oil pump directly coupled to said input shaft.

10. The compression system of claim 9, wherein:

said oil pump is disposed between said compressor housings.

11. The compression system of claim 7, further comprising:

at least three compressor housings comprising integral volute type scrolls and at least two intercooler housings all made in one casting.

12. The compression system of claim 11, further comprising:

said gearbox housing component integrally cast with said intercooler housings and said compressor housings.

13. The compression system of claim 12, further comprising:

an input shaft extending through said gearbox housing component and directly driving an oil pump.

14. The compression system of claim 13, wherein:

two of said compressors are driven on a common shaft operably connected to said input shaft on an opposite side of said gear box housing component from said third compressor and said oil pump is disposed adjacent said input shaft and between two of said compressors.

15. The compression system of claim 14, wherein:

said compressors are connected for staged compression with the integrally cast outlet of a first stage compressor extending into the integrally formed first stage intercooler housing and the outlet of a second stage compressor extending into an integrally formed second stage intercooler.

16. A compression system comprising at least one centrifugal compressor, said centrifugal compressor further comprising:

an impeller further comprising a plurality of blades having an outer edge and extending from adjacent a center thereof, said impeller supported on an impeller shaft;

a compressor housing comprising an inlet opening in general axial alignment with said center;

a gearbox housing component;

said compressor housing comprises a volute type scroll integrally cast with said gearbox housing component, said compressor housing further comprises an outlet and a shaft opening through which said shaft is inserted.

17. The compression system of claim 16, further comprising:

a gearbox having an input shaft and a plurality of gears to rotate said impeller shaft; and an oil pump directly driven from said gearbox input shaft.

18. The compression system of claim 16, wherein:

said at least one centrifugal compressor comprises a plurality of centrifugal compressors with at least two having compressor housings comprising integral volute type scrolls and gearbox housing components and an inlet which comprises a distinct component, said compressors connected in series for staged compression.

19. The compression system of claim 18, further comprising:

at least one intercooler housing, said compressor housings cast as one piece with said intercooler housing.

20. The compression system of claim 19, further comprising:

an input shaft extending through said gear box and operably connected by gears to compressor shafts extending from said compressors, said compressor shafts disposed on opposite sides of said input shaft; and an oil pump directly coupled to said input shaft.

21. The compression system of claim 19, wherein:

said compressors are connected for staged compression with the integrally cast outlet of a first stage compressor extending into the integrally formed first stage intercooler housing and the outlet of a second stage compressor extending into an integrally formed second stage intercooler.

* * * * *